US005228560A

United States Patent [19]

Näslund

[11] Patent Number: 5,228,560

[45] Date of Patent: Jul. 20, 1993

[54] ELECTRICAL CONTACT UNIT, PARTICULARLY AN ELECTRICAL SWITCH

[76] Inventor: Leif Näslund, Rågvägen 31, S-892 00 Domsjö, Sweden

[21] Appl. No.: 778,215

[22] PCT Filed: Jun. 11, 1990

[86] PCT No.: PCT/SE90/00404

§ 371 Date: Dec. 16, 1991

§ 102(e) Date: Dec. 16, 1991

[87] PCT Pub. No.: WO91/00604

PCT Pub. Date: Jan. 10, 1991

[30] Foreign Application Priority Data

Jun. 27, 1989 [SE] Sweden ..... 8902312

Sep. 12, 1989 [SE] Sweden ..... 8902981

[51] Int. Cl.[5] ..... H01H 1/06; H01H 15/00

[52] U.S. Cl. ..... 200/275; 200/537; 200/538; 200/540; 439/842; 439/851

[58] Field of Search ..... 200/537, 538, 540, 541, 200/542, 51.08, 51.09, 51.11, 51.12, 51.13, 51 R, 504, 275; 439/310, 334, 700, 842, 843, 851, 856, 857, 137, 138, 139; 285/47

[56] References Cited

U.S. PATENT DOCUMENTS 4,655,526 4/1987 Shaffer ..... 439/843

4,662,706 5/1987 Foley ..... 439/843

4,714,441 12/1987 Colman ..... 439/842

5,135,417 8/1992 Stanevich ..... 439/851

*Primary Examiner*—Henry J. Recla

*Assistant Examiner*—David J. Walczak

*Attorney, Agent, or Firm*—Griffin, Butler, Whisenhunt & Kurtossy

[57] ABSTRACT

An electrical contact device has a first connector (1) having a surrounded base portion (3). Radially disposed within the base portion is a plurality of contact members (5) with at least a surface portion of the contact members being in electrical contact with the base portion through, at least in part, flexible, electrical conducting connections (6). Each contact member is in the form of a double-armed lever with a first arm (15) and a second arm (16) carrying the surface portion, and each contact member is pivotable about an intermediate portion (19) between the first arm and the second arm. A second connector (2) has an electrical conductive contact surface (26) and is receivable and movable in the first connector. The second connector is pressable against the first arm, such as to pivot the double-armed lever from an open position where the surface portion does not contact the conductive contact surface to a closed position where the surface portion does contact the conductive contact surface. An urging member (13) urges the double-armed lever into the open position when the second connector is not pressed against the first arm.

8 Claims, 1 Drawing Sheet

ELECTRICAL CONTACT UNIT, PARTICULARLY AN ELECTRICAL SWITCH

TECHNICAL FIELD

This invention relates to an electrical contact unit, particularily an electrical switch or circuit breaker, comprising a first and a second connector which are provided to be brought towards and from each other in order to close or to break a circuit, one of said first and second connectors comprising a base portion and a plurality of contact members which are in electrical contact with the base portion, said contact members being provided to be brought to electrical and mechanical contact with the other connector when closing the circuit. The unit is useful as a closing as well as a disconnecting unit, as a contact unit in tube conductors, and for connecting various electrical units, just to mention a few of many conceivable applications of the invention.

BACKGROUND OF THE INVENTION

Generally, movements which generate small abraded metal particles occur between the surfaces of contact in electrical contact units. These movements may have various causes. For example, in closed units very slow movements may occur because of thermal conditions, but also fast vibration movements may occur. Further, a sliding movement normally takes place between the surfaces of contact during the closing and breaking of conventionally designed contact units. Undependent of the cause and nature of the movements, the movements always will lead to wear of the contact units in the points of contact. This is a problem, and this particularily concerns such switches or corresponding devices where the surfaces of contact have been specially prepared in order to give good contact. Thus it is common practice to silver-plate the contact surfaces of the contact units in heavy power breakers. However, because of the relative movements between the connectors of the breaker, the silver-plating is damaged, and there is also a risk for spark formation because of the said generation of particles, so that the operation of the switch or breaker successively is impared, at the same time as the said generation of particles may give rise to disastrous sparkovers.

BRIEF DISCLOSURE OF THE INVENTION

It is an object of the present invention to provide a contact unit in which relative movements between the contact surfaces do not occur when the unit is closed. It is another object to provide the smallest possible relative movement between the contact surfaces during the closing and breaking of the contact. In other words, it is an object to provide a static point of contact where the current shall be transferred. The invention has been designed in the first place for heavy power breakers, but the principles of the invention are not restricted to this field but can be applied also for smaller currents and voltages as well as within the field of micro-electronics.

These and other objects can be achieved wherein one of said first and second connectors comprises a base portion and at least one contact member in electrical contact with the base portion, that said contact members consist of rocker-arms which at least partly consist of electrically conducting material and exhibit a first contact surface, that the rocker-arms also exhibit a trigger portion with a push surface which is not said first contact surface, that said other connector is provided to be pressed against the trigger portion of the rocker-arms through a relative movement between the connectors so that the rocker-arms will turn over from a rest position, where there is no contact between said first and second contact surfaces, to an operation position in which said first and second contact surfaces fixedly contact each other without any possibility to move relative to each other, while that system which consists of the other connector and said rocker-arms in contact with said other connector on the other hand may move in all directions relative to the base portion of the first connector which is in contact with the rocker-arms via flexible, electrically conducting connections between the rocker-arms and the base portion.

Preferably, the first connector is a female connector and the second connector is male connector, but also the vice versa condition is possible per se, if a flexible, electrically conducting connection is provided between the contact member and the base portion of the first connector.

Further characteristic features and aspects and advantages of the invention will be apparent from the appending claims and from the following description of a preferred embodiment.

BRIEF DESCRIPTION OF DRAWINGS

In the following description of a preferred embodiment, reference will be made to the accompanying drawings, in which.

DESCRIPTION OF PREFERRED EMBODIMENT

Figure 1:
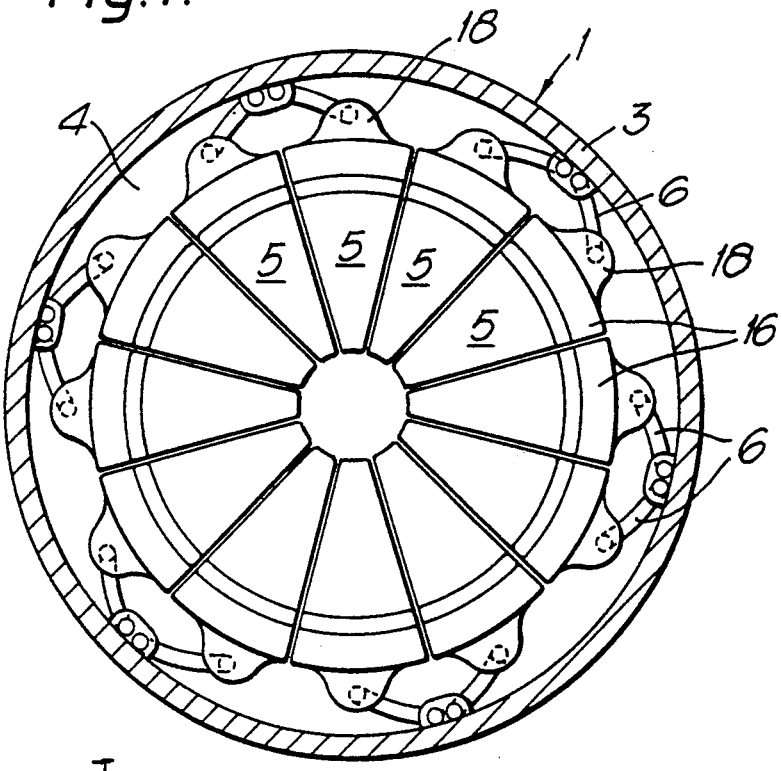
FIG. 1 is a view along the line I—I in FIG. 2 of the first connector which according to the embodiment is a female connector in the contact position with the male connector omitted for clarity and FIG. 2 is an axial section through the switch, the upper half of the section showing the switch in non-contact position, i.e. in non-conducting position, and the lower half showing the switch in contact position, i.e. in closed position.

The switch comprises a first connector 1, which is a female connector, and a second connector 2, which is a male connector.

The female connector 1 consists of an annular base portion 3 of electrically conducting material with a base plate 4 which suitably also consists of conducting material. Twelve contact members 5 of electrically conducting material are arranged in the shape of a ring around the center axis of the switch, and between each contact member 5 and the base portion 3 is an electrically conducting strand 6, for example a braid of metal wire.

In the front part of base portion 1 there is provided a contracted opening 7, into which the male connector 2 is provided to be inserted. The opening 7 is surrounded by a ring 8 of an electrically non-conducting suitably refractary material, e.g. porcelain, Teflon (PTFE) or the like. On the inner side of the ring 8, base portion 3 exhibits an annular shoulder 10. The female connector 1 further comprises a clamping ring 11 with an annular projection or tongue 12 provided to be clamped against the contact members 5 by means of a helical pressure spring 13 provided between base plate 4 and clamp ring 11.

The twelve contact members 5 are identically designed and have the shape of a rocker-arm or double-armed lever. Each such rocker-arm 5 thus exhibits a longer arm 15 which may be called a trigger, and which extends radially inwards and slightly forwards towards the male connector 2, and a shorter arm 16, which may be called a contact arm, and which extends substantially axially forwards towards the outer part of the female connector. The contact members 5 further narrow towards the center of the switch so that they, in an end view, have the shape of a sector of a circle. On the outer side of each contact arm 16, on a small extension or stop portion 18, there is a stop surface 17 provided to be able to operate with the shoulder 10 on the base portion of the female connector. The strands 6 are provided between said projections or stop portions 18 and the base portion 3.

On the rear side of each contact member 5 (contact arm), in the angle between the longer arm (trigger) 15 and the shorter arm 16, there is a rounded groove 19 for the tongue 12 on the clamp ring 11. An outer surface in the front of the contact arm has been designated 20 and an annular surface on the shoulder 10 on the base portion 3 of the female connector 1 has been designated 21. In combination, surfaces 20 of the twelve contact members (rocker-arms) 5 match the annular surface 21. The surface on the inner side of each shorter arm (contact arm) 16 has been designated 22. These surfaces 22 define the contact surfaces of the female connector 1 and are silver-plated.

Male connector 2 consists of a cylindrical metal rod which in its front end is provided with a recessed metal plate or washer 24. Washer 24 exhibits an abutment surface 25 intended to co-operate with the front side of the triggers 15 of the rocker-arms 5. A silver-plated, annular, circumferential contact surface 26 on the outer side of the male connectors 2 is intended to be brought to contact with the contact surfaces 22 of the rocker-arms 5.

Figure 2:
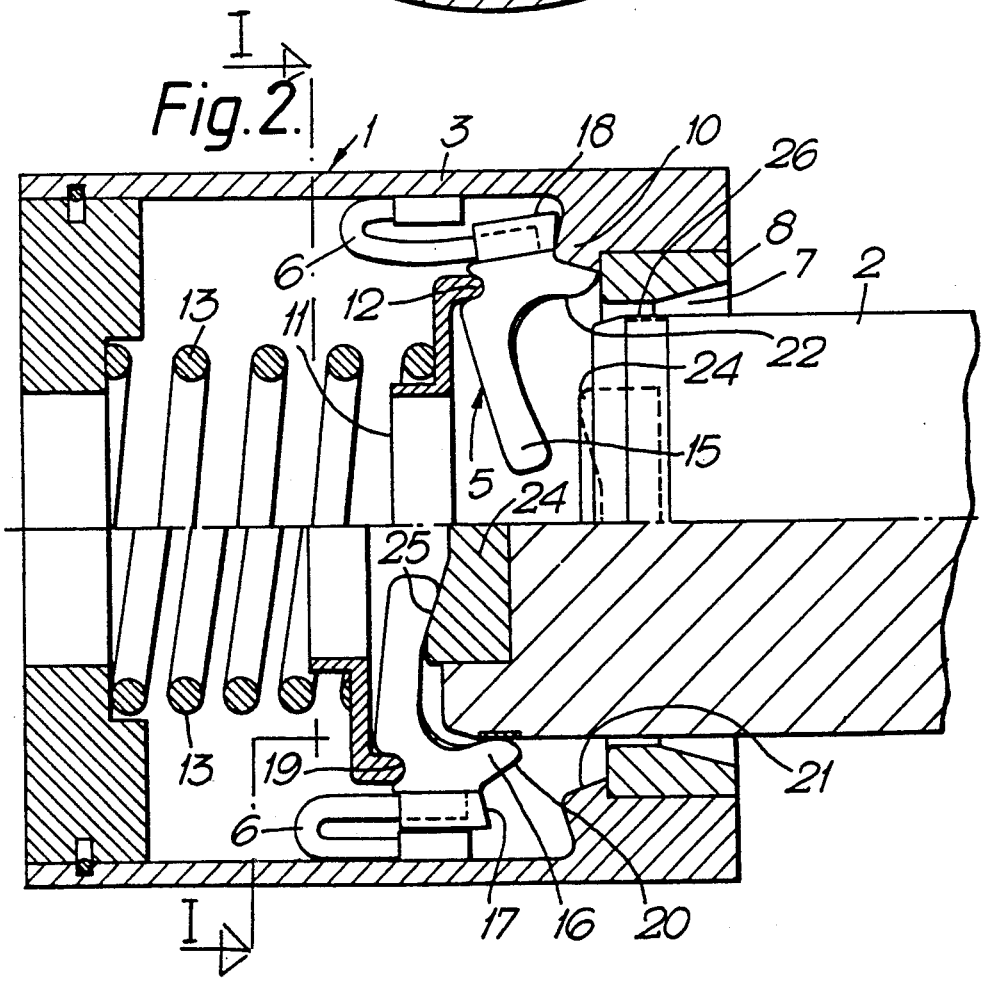

The above described switch operates in the following way. It is supposed that the switch initially is broken, as is shown in the upper part of FIG. 2, wherein the contact arms of the contact members/rocker-arms 5 are being pressed with the surface 20 against the annular surface 21 of shoulder 10 on the female connector 1. The contact pressure is generated by means of spring 13 which presses against the rear side of the clamp ring 11. The triggers 15 in this stage point radially inwards and slightly forwards towards the male connector 2. When the switch shall close the circuit, the male connector 2 is moved into the female connector 1, so that the abutment surface 25 of the washer 24 is pressed against the front side of triggers 15. During the continued movement of the male connector 2 into the female connector 1, the spring 13 will be contracted. At the same time, the rocker-arms 5 are turned in the grooves 19 about the tongue 12 of the clamp ring 11. The rocker-arms herethrough turn over from contact between surfaces 20 and 21 to contact between contact surfaces 22 of the rocker-arms 5 and the contact surface 26 of the male connector 2. The switch then has closed an electric circuit between the base portion 3 of female connector 1 and the male connector 2 via the strands 6 the contact members/rocker-arms 5, and contact surfaces 22, 26.

If the base portion of female connector 1 and the male connector 2 in the closed switch would move relative to each other, these movements would completely be neutralised by the spring 13 so that the contact surfaces 22 and 26 will be completely motionless relative to each other. The electrical connection at the same time is secured via the flexible strands 6.

The breaking of the circuit is performed in the opposite way. The male connector 2 is drawn out of the female connector 1. The contact members/rocker-arms 5 will follow in this movement under the influence of the spring 13 until the stop portions 18 with their stop surfaces 17 will abut the annular shoulder 10 in the outer part of the base portion 3 of the female connector 1. The male connector 2, however, continues its movement out of the female connector 1, breaking the contact between contact surfaces 22 and 26, and the rocker arms 5 are turned to their initial positions by means of the spring 13, so that also the contact of the triggers 15 with the contact surface 25 of the washer 24 is broken and the surfaces 20 are again caused to contact the annular surface 21 of shoulder 10. Any electric arc possibly occuring in the moment of this connection therefor will take place only between the electrically conducting triggers 15 of rocker-arms 5 and the contact surfaces 25 of the washer 24. By this way, it is avoided that the contact surfaces 22 and 26 are damaged because of electric arc generation. When the breaker is switched in, the contact members 5 thus are firmly clamped in three points, namely through contact between contact surfaces 22 and 26, between trigger arms 15 and the washer 24, and between the tongue 12 of the clamp ring 11 and the groove 19. In the switched off position, the triggers 15 are clamped between the tongue 12 of the clamp ring 11 in the groove 19 and the surface 21 of shoulder 10.

The switch may be completely with means for extinguishing electric arcs between the contacts according principles known per se, utilizing compressed air, oil, or the like.

I claim:

1. An electrical contact device comprising:

(a) a first connector (1) having a surrounding base portion (3);

(b) a plurality of contact members (5) disposed within the base portion with at least a surface portion thereof being in electrical contact with the base portion through, at least in part, flexible, electrical conducting connections (6), each contact member being in the form of a double-armed lever with a first arm (15) and a second arm (16) carrying said surface portion and each contact member being pivotable about an intermediate portion (19) between the first arm and the second arm;

(c) a second connector (2) having an electrical conductive contact surface (26) and being receivable and movable in the first connector and being pressable against each first arm such as to pivot each double-armed lever from an open position where said surface portion does not contact said conductive contact surface to a closed position where said surface portion does contact said conductive contact surface; and (d) urging means (13) for urging said double-armed levers into said open position when said second connector is not pressed against each first arm.

2. The device according to claim 1 wherein the first connector is a female connector (1) and that the second connector is a male connector (2).

3. The device according to claim 1, wherein the double-armed levers (5) are radially disposed and concentrical with a center axis of an annular base portion of said first connector.

4. The device according to claim 3, wherein the double-armed levers when in the closed position are closely adjacent each other at side surfaces thereof and when viewed in an axial direction each has substantially the shape of a circular sector.

5. The device according to claim 1, wherein said urging means is a spring member (13) provided in the first connector and presses each second arm (16) against a portion of the first connector when the device is in the open position and presses each second arm (16) against the second connector when the device is in the closed position.

6. The device according to claim 1, wherein a front portion of the second connector (2) is pressable against each first arm when the device is to be closed.

7. The device according to claim 5, wherein said spring member presses each lever against the second connector (2) via an annular, floatingly mounted member (11), which contacts a pivot (19) between the first arm and the second arm.

8. The device according to claim 1, wherein a front portion of the second connector (2) has a contact element (24) having an electrically conducting contact surface (25) which is pressable against each first arm (15) so that any electrical arc which may be generated will occur between said contact element and said first arms.

* * * * *